US007011117B1

(12) United States Patent
Carpino et al.

(10) Patent No.: US 7,011,117 B1
(45) Date of Patent: Mar. 14, 2006

(54) FILLING VALVE

(76) Inventors: Gerald Albert Carpino, 517 Via El Risco, San Clemente, CA (US) 92673; Peter Todd Carpino, 26581 San Torini Rd., Mission Viejo, CA (US) 92692

( * ) Notice: Subject to any disclaimer, the term of this patent is extended or adjusted under 35 U.S.C. 154(b) by 0 days.

(21) Appl. No.: 10/989,471

(22) Filed: Nov. 15, 2004

(51) Int. Cl.
*B65B 1/04* (2006.01)

(52) U.S. Cl. ..... 141/89; 141/301; 251/324

(58) Field of Classification Search ..... 141/89–92, 141/301, 302; 251/318, 324
See application file for complete search history.

(56) References Cited

U.S. PATENT DOCUMENTS 2,152,831 A * 4/1939 Williams ..... 251/210
3,110,471 A * 11/1963 Kuhles ..... 251/318
6,546,970 B1 * 4/2003 Gatteschi ..... 141/106
6,761,191 B1 * 7/2004 Rosen et al. ..... 141/91

* cited by examiner

*Primary Examiner*—Steven O. Douglas
(74) *Attorney, Agent, or Firm*—Cohen Sakaguchi & English LLP

(57) ABSTRACT

An improved filling valve and liquid filling machine comprising such valve are herein disclosed. The filling valve comprises a housing having a base, a cap and a sidewall extending between the base and the cap thereby defining a chamber. The base has a ramp which slopes from a bottom surface of the base toward the cap. An outlet tube extends from said housing and has an inlet opening in fluid communication with the chamber. An inlet port extends through the sidewall to allow liquid product to enter the chamber. A plunger guide having an opening is provided on the cap with the opening extending through the cap. A plunger is slidably received in the outlet tube and the opening in the plunger guide. The plunger is movable between a position in which the plunger seals the outlet tube thereby closing the valve and a position in which the plunger is withdrawn from the outlet tube thereby unsealing the outlet tube and thereby opening the valve. The filling valve may be utilized on a liquid filling machine to fill containers with liquid product.

25 Claims, 6 Drawing Sheets

FILLING VALVE

FIELD OF THE INVENTION

The present invention relates generally to the field of liquid filling machinery for filling containers such as bottles, cans, and jars, and more particularly to an improved filling valve for use in such machinery.

BACKGROUND OF THE INVENTION

The high-throughput filling of containers with liquids is accomplished using precision, automated liquid filling systems. These high speed liquid filling systems are used for filling containers such as bottles, cans and jars with a wide variety of consumer products including foods, drinks, personal care products, home care products, automotive products, pharmaceuticals and more.

A typical liquid filling system includes a container handling device, a liquid filling machine and a capping/lidding machine. The container handling device transports unfilled containers to the liquid filling machine and then transports the filled containers from the filling machine to the capping/lidding machine. The container handling device commonly comprises one or more conveyors and may also include one or more indexing devices such as gates, star wheels or spindles. The liquid filling machine comprises a plurality of filling stations such that it can simultaneously fill multiple containers. Each filling station includes a nozzle and a valve connected to a source of liquid product such as a tank or reservoir. The nozzles direct liquid product into the container. The nozzle may be configured to physically engage the opening in the container, to be placed through the opening and into the interior of the container, or simply to be placed in the vicinity of the opening in the container. The liquid product may be pumped to the nozzles of each filling station using a pump such as a positive displacement pump, by a source of pressure such as compressed air, or simply by gravity feed. The nozzle and valve may be separate components or they may be integrated into a single device. The valve is opened and closed to control the flow of liquid product that flows through the nozzle and into the container. In order to minimize foaming and splashing of product during the filling process, each filling station may include a bottom-up fill mechanism which places the nozzle tip in the vicinity of the bottom of the container at the initiation of the filling process and then withdraws the nozzle as the container is filled and the product level rises. The relative movement of the nozzle and the container may be accomplished by lowering and raising the nozzle, the container or both. The system may also include a labeling machine and a packing station for packing a plurality of filled containers into cartons or boxes for shipping.

Liquid filling machines are generally of two types, rotary filling machines and in-line filling machines. Because it easily allows for fast, continuous motion of containers, rotary filling machines are the fastest known architecture. Turning to FIG. 1, a typical rotary filling machine 10 is shown. The rotary filling machine 10 comprises a plurality of filling stations 12, arranged around the circumference of a revolving rotor 14 which rotates in the direction shown by arrow 11. Each filling station 12 includes a filling device 16 typically having a nozzle 18 and a container holding device (not shown) for securely holding and aligning each container as the containers rotate with the rotor 14 during the filling process. Each nozzle 18 is connected to a hose 20. The other end of the hose 20 is connected to a product reservoir (not shown). A conveyor 22 transfers empty containers to an input spindle 13 which synchronously feeds the each successive empty container to a filling station 12. As each container travels around the filling zone with the rotor 14, the container is filled with product by the filling device 16. Once the container is filled, it has rotated to an output spindle 23 which removes the container from the filling station 12 and feeds the filled container back to the conveyor 12. Another section of the conveyor 22 may then transport the filled containers to a capping/lidding machine (not shown), labeling machine (not shown) and/or a packing station (not shown). Several rotary filling machines are described in U.S. Pat. No. 6,761,191 and U.S. Pat. No. 6,474,368, the disclosures of which are hereby incorporated by reference herein in their entireties.

In-line filling systems are characterized by the motion of the containers in a generally straight line through the product filling area. There are many types of in-line filling systems but they can be broken down into two types of motion, namely intermittent motion and continuous motion. In the intermittent motion designs, a group of empty containers are serially conveyed or indexed into a plurality of filling stations. The containers are then completely filled while they remain fixed and motionless. Once this group of container is filled, an indexing mechanism transports the filled group of containers out of the filling area and another group of empty containers are conveyed into the position of the filling stations. In order to increase the throughput of this type of in-line filling system, various derivative designs have been devised to increase the throughput. These include the multiple parallel lane and nozzle design, the dead plate pushover design, the shifting nozzle design, and the parallel lane/staggered nozzle design.

Each of these designs is described in detail in U.S. Pat. No. 5,878,796, the disclosure of which is hereby incorporated by reference herein in its entirety.

It is also possible to have an in-line filling system which provides for continuous motion of the containers. One such design is the walking beam design, an example of which is shown in FIG. 2. The walking beam filling system 30 comprises a conveyor 32 which transports containers 34 to and from the liquid filling zone 36. The containers 34 move continuously in a straight line along the conveyor 32. A bank of nozzles 38 is mounted to a beam 40. The nozzles 38 are spaced apart such that each nozzle will align with the opening of the same number of containers 34 as the containers 34 travel through the filling zone 36. The beam 40 is affixed to a motorized beam mechanism 42 which moves the bank of nozzles 38 laterally back and forth along the same line as the containers 34 on the conveyor 32. The motorized beam mechanism 42 moves the beam 40 and the bank of nozzles 38 in the direction 44 synchronously with the movement of a group of containers 34 as the containers 34 are filled by the nozzles 38. The motorized beam mechanism 42 then returns the beam 40 and nozzles 38 back in the direction 46 at a rate of speed substantially greater than the speed of the conveyor 32. A filling cycle begins when the beam 40 is accelerated from rest at an initiation point to match the speed of the movement of the continuously moving containers 34 on the conveyor 32 and the nozzles 38 are positioned over the openings in the containers 32. The nozzles 38 are then lowered into the empty containers 34 entering the filling zone from an input side of the conveyor 32. The containers 34 are filled with liquid product while the beam 40, nozzles 38 and containers 34 continue to move synchronously along with the conveyor 32. Upon completion of the filling, the nozzles 38 are retracted from the containers 34 and the beam 40 is stopped and reversed. The beam moves at a very rapid speed back toward the input side of the conveyor and stops at its initiation point.

Rotary filling systems and in-line filling systems have several advantages and disadvantages as compared to the other. As stated above, rotary filling machines are the fastest configuration because they allow for rapid, continuous motion of containers without the need for reversing or shifting the movement of any system components. In order to increase the throughput of a rotary filling machine, for a given rate of rotation of the rotor 42, the number of filling stations is increased. However, this may require increasing the diameter of the rotor. It is generally faster and easier to make a product changeover of an in-line machine from one product type or container type to another. It is also easier, on average, to increase the number of filling stations to an in-line system simply by adding modules to the system. Walking beam filling systems are described in detail in U.S. Pat. No. 5,878,796 and U.S. Pat. No. 6,761,191, the disclosures of which are hereby incorporated by reference herein in their entireties.

Each of the liquid filling systems requires one or more valves in the system to precisely dispense the desired amount of liquid product into the containers being filled. The valves are typically controlled by synchronized cams, hydraulic cylinders or air cylinders. Various types of valves have been used in automated liquid filling machines. For example, U.S. Pat. No. 5,058,632 describes a filling valve assembly specifically designed for use in bottling carbonated liquids, the disclosure of which is hereby incorporated by reference herein in its entirety. The filling valve described therein comprises a housing with a chamber therein. The chamber has an inlet opening for receiving liquid product into the chamber. A portion of the chamber defines a valve seat. A cylindrical valve stem extends through the chamber of the housing and out of the chamber through an opening in the valve seat. The valve stem has valve seal located within the chamber. Movement of the valve stem moves the valve seal moves between a closed position in which the valve seal is seated firmly on the valve seat and an open position in which the valve seal is moved away from the valve seat thereby creating a flow path between the valve seal and the opening in the valve seat. The opening in the valve seal is in fluid communication with the outlet of the valve. The valve may be actuated by a cam or a lever which are operably coupled to the valve stem to move the valve stem between the open and closed positions.

Another valve is disclosed in U.S. Pat. No. 6,761,191. The valve is quite similar to the valve described immediately above, except that it provides for almost complete product displacement (the condition in which the valve seats at the final point of discharge through the outlet) and it is actuated using pneumatic pressure and air cylinders.

These valves have various drawbacks when used for filling containers with semi-viscous liquids and/or liquids having mixed-in solid particles or particulate. A significant drawback to each of the previously described valves is that the valves have areas prone to clogging and product entrapment. In addition, none of these valves provides for low velocity discharge prior to the product reaching the point of vertical dispensing. A low velocity discharge prior to vertical dispensing nas several important benefits including better control of product flow through the nozzle, reduction of spurting, scatter and foaming during the product dispensing and smoother product flow upon opening of the valve from the closed position. In addition, the valve disclosed in U.S. Pat. No. 5,058,632 will be susceptible to dripping because the valve seat does not seal at the final point of discharge through the outlet, sometimes referred to as complete or positive displacement of product.

Accordingly, there is a need for an improved valve for liquid filling systems which overcomes the deficiencies of previous valves.

SUMMARY OF THE INVENTION

The improved filling valve of the present invention is particularly useful in automated liquid filling systems for filling containers with liquid products. The valve of the present invention is a plunger style valve, as opposed to valves having valve seats and a seal which seals on the valve seat. Instead of a valve seal, the filling valve of the present invention utilizes a plunger slidably received within an outlet tube. The plunger has a tight tolerance fit within the outlet tube such that the plunger effectively seals the outlet tube when the plunger is inserted into the outlet tube. This type of configuration allows for precise product flow control and complete product displacement to prevent dripping.

Accordingly, the valve of the present invention comprises a housing having a base, a cap and a sidewall extending between the cap and the base. In a particularly innovative aspect of the invention, the base of the housing has a ramp which slopes from a bottom surface of the base toward the cap. The base, cap and sidewall form a substantially enclosed chamber.

The outlet tube of the valve extends from the exterior of the housing through the base and into the chamber. The outlet tube has an inlet opening which opens into the chamber to allow product to flow from the chamber into the outlet tube when the plunger is removed from the outlet tube, i.e. when the valve is in the open position. The outlet tube also has an outlet opening which allows product to flow out of the valve and into a container being filled. A product inlet port extends from the exterior of the housing, preferably through the sidewall, and is in fluid communication with the chamber. The product inlet port is connected to a source of product, and directs the product into the chamber of the housing.

A plunger guide is provided on or in the cap and has an opening extending through the cap. As with the outlet tube, the plunger guide slidably receives the plunger and has a tight tolerance fit with the plunger such that the plunger seals the opening extending through the cap.

The valve of the present invention is preferably a clean-in-place (CIP) component meaning that the surfaces of the valve which come into contact with liquid product may be cleaned without removing them from the liquid filling device on which the valve is utilized. The CIP process typically entails running the liquid filling device with a cleaning solution in the place of liquid product thereby flushing and cleaning all of the product contact parts of the liquid filling device, including the valve. Accordingly, any seals utilized in the valve are preferably sanitary clean-in-place seals which are specifically designed to be cleanable during a CIP cleaning process.

The operation of the valve is fairly straightforward. A source of pressurized product is connected to the inlet port of the valve and a container to be filled is positioned adjacent the outlet opening of the outlet tube. The valve begins in the closed position with the plunger extended into the outlet tube such that the outlet is sealed. Some product will flow into the chamber through the inlet port thereby filling the chamber. The valve is opened by withdrawing the plunger from the outlet tube. Removing the plunger completely from the outlet tube unseals the inlet opening in the outlet tube thereby allowing the product to flow from the chamber into the outlet tube, out of the outlet opening and into the container. When opening the valve, the plunger is not withdrawn far enough that the end of the plunger is removed from the plunger guide such that the seal between the plunger and the plunger guide is always maintained.

Once the container is filled, the valve is closed by simply re-inserting the plunger into the outlet tube thereby sealing the outlet.

An automated liquid filling system according to the present invention comprises a container handling subsystem, a liquid filling machine and a controller. The container handling subsystem transports the containers to and from the liquid filling machine. The liquid filling machine comprises a plurality of fillings stations for filling the containers. Each filling station has a valve according to the present invention and an actuation device for moving the plunger between the open and closed positions. Finally, the system has a controller in operable communication with the container handling subsystem and the liquid filling machine to control and coordinate the operation of the liquid filling system.

The foregoing, together with features and advantages of the present invention, will become more apparent when referring to the following detailed description, accompany drawings and claims.

DETAILED DESCRIPTION OF THE INVENTION

Figure 1:
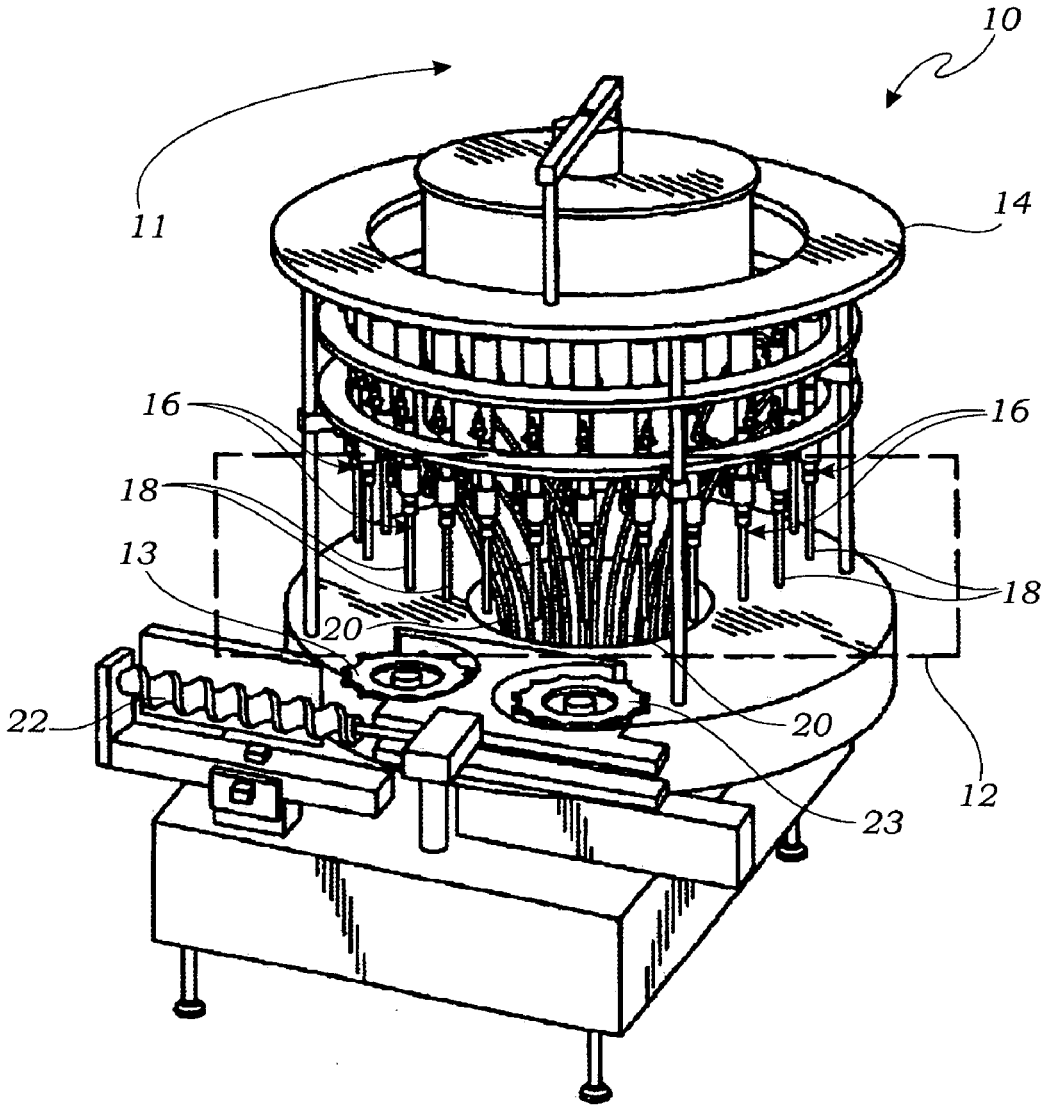
FIG. 1 is a perspective view of an exemplary rotary liquid filling system.
Figure 2:
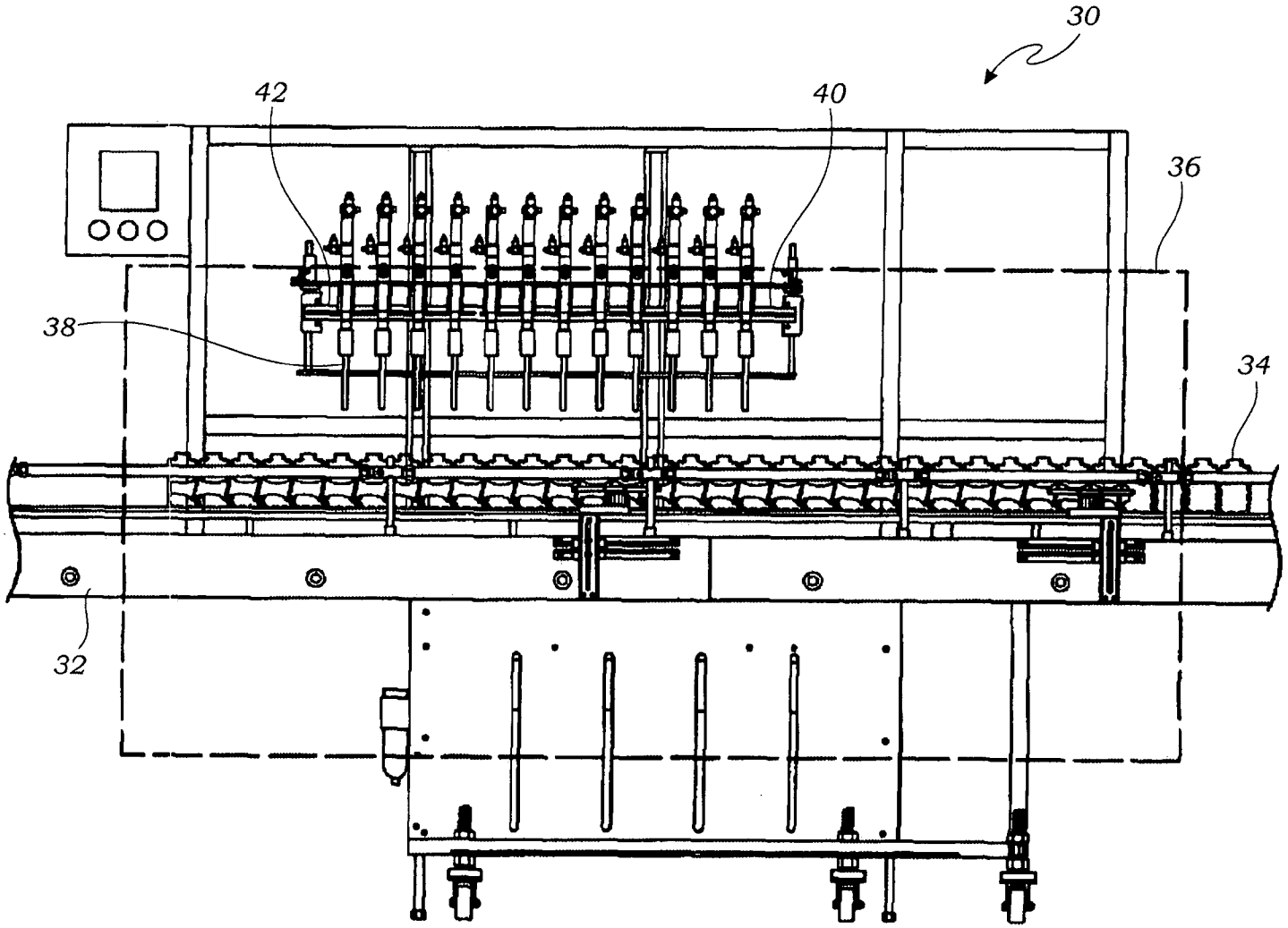
FIG. 2 is a front view of an exemplary in-line "walking beam" liquid filling system.
Figure 3:
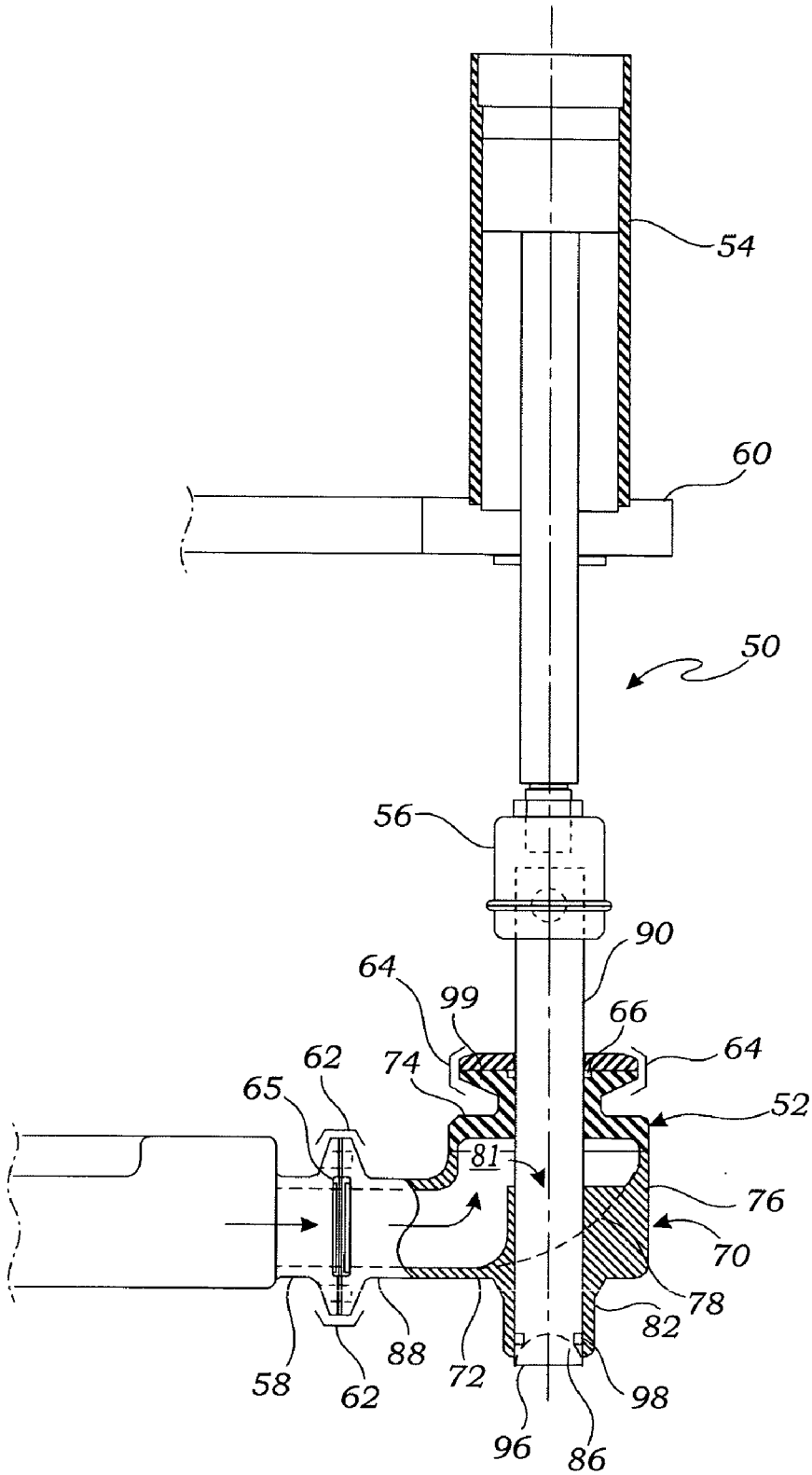
FIG. 3 is a side view of a liquid filling station having a filling valve according to the present invention with the valve in the closed position.
Figure 4:
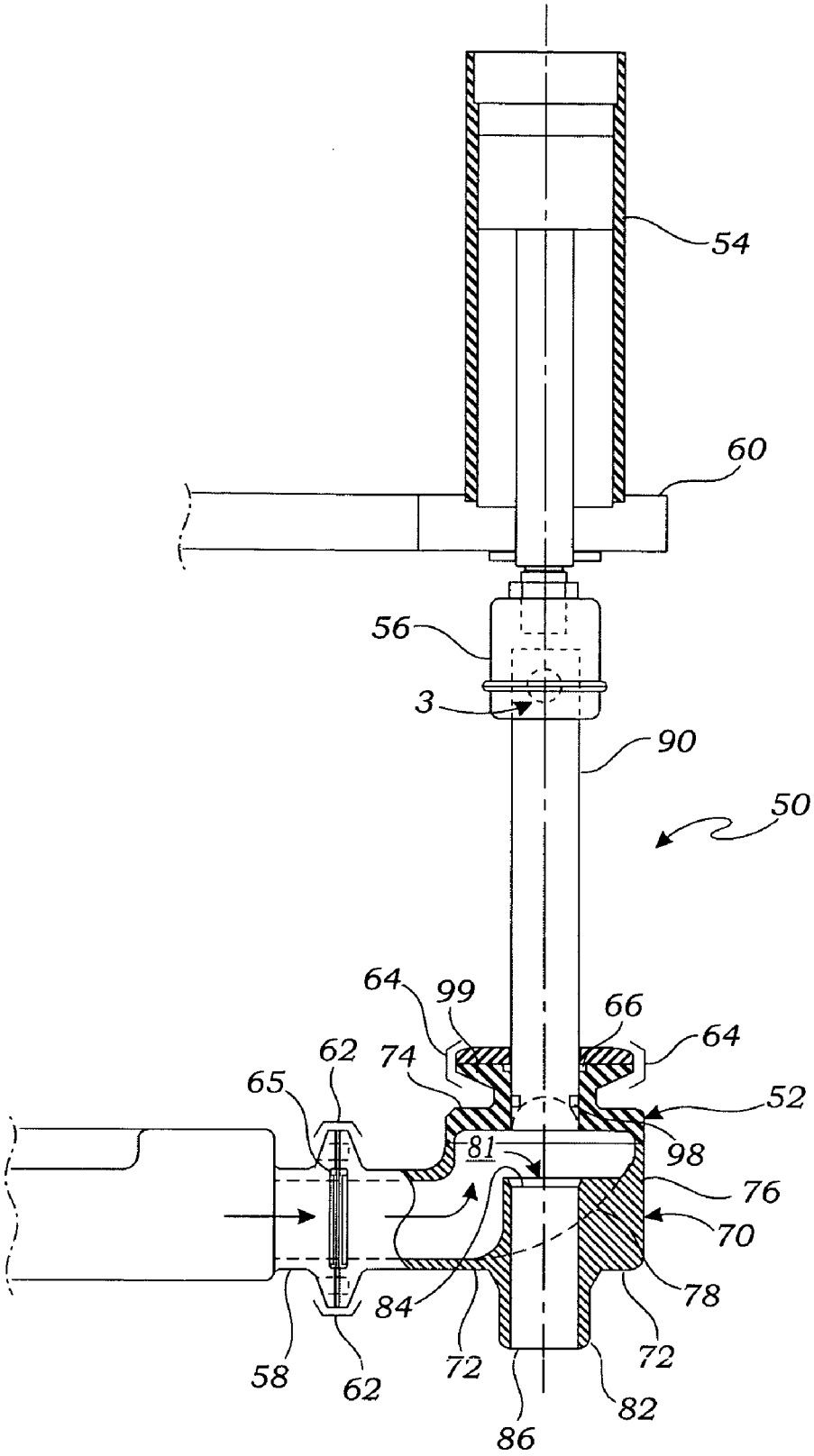
FIG. 4 is a side view of the liquid filling station of FIG. 3 with the valve in the closed position.
Figure 5:
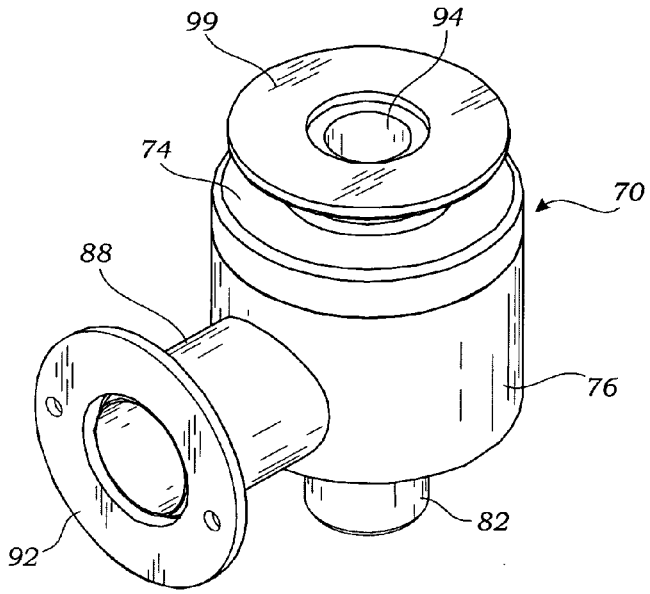
FIG. 5 is a cross-sectional perspective view of the housing of the valve shown in FIGS. 1–4.

Turning to FIG. 3 and FIG. 4, a filling valve 52 according to the present invention is shown incorporated into a filling station assembly 50. The filling station assembly 50 includes the filling valve 52 operably coupled to an air cylinder actuator 54 by a coupler 56. A product supply pipe 58 is attached to a product inlet port 88 of the filling valve 52 by a clamp 62. A sanitary inlet seal 65 is provided between the supply pipe 58 and the inlet port 88 to provide a liquid tight seal. The seal 65 is preferably a clean-in-place seal such that the seal 65 and surrounding valve structure may be cleaned without disassembling the inlet port 88 from the supply pipe 58. A cap retainer 64 is attached to a cap 74 of the valve 52 by a clamp 64. A sanitary cap seal 66 is held in place by the cap retainer 64. The sanitary seal 66 helps seal the valve 52 by preventing product from flowing between the plunger 90 and the outlet tube 82 of the valve 52. The seal 66 is preferably a clean-in-place seal such that the seal 66 and surrounding valve structure may be cleaned without disassembling the inlet port cap retainer 64 from the cap 74. The air cylinder 54 is mounted to a mounting ring 60 of a liquid filling station 100 (see FIG. 8).

Figure 6:
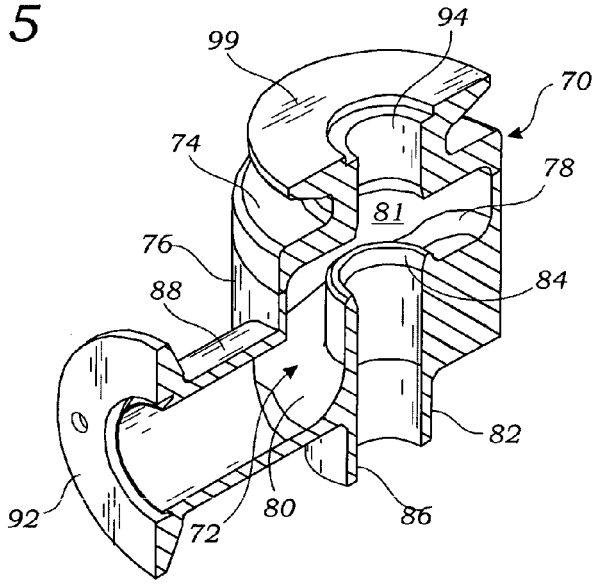
FIG. 6 is a perspective view of the housing of the valve shown in FIGS. 1–5.
Figure 7:
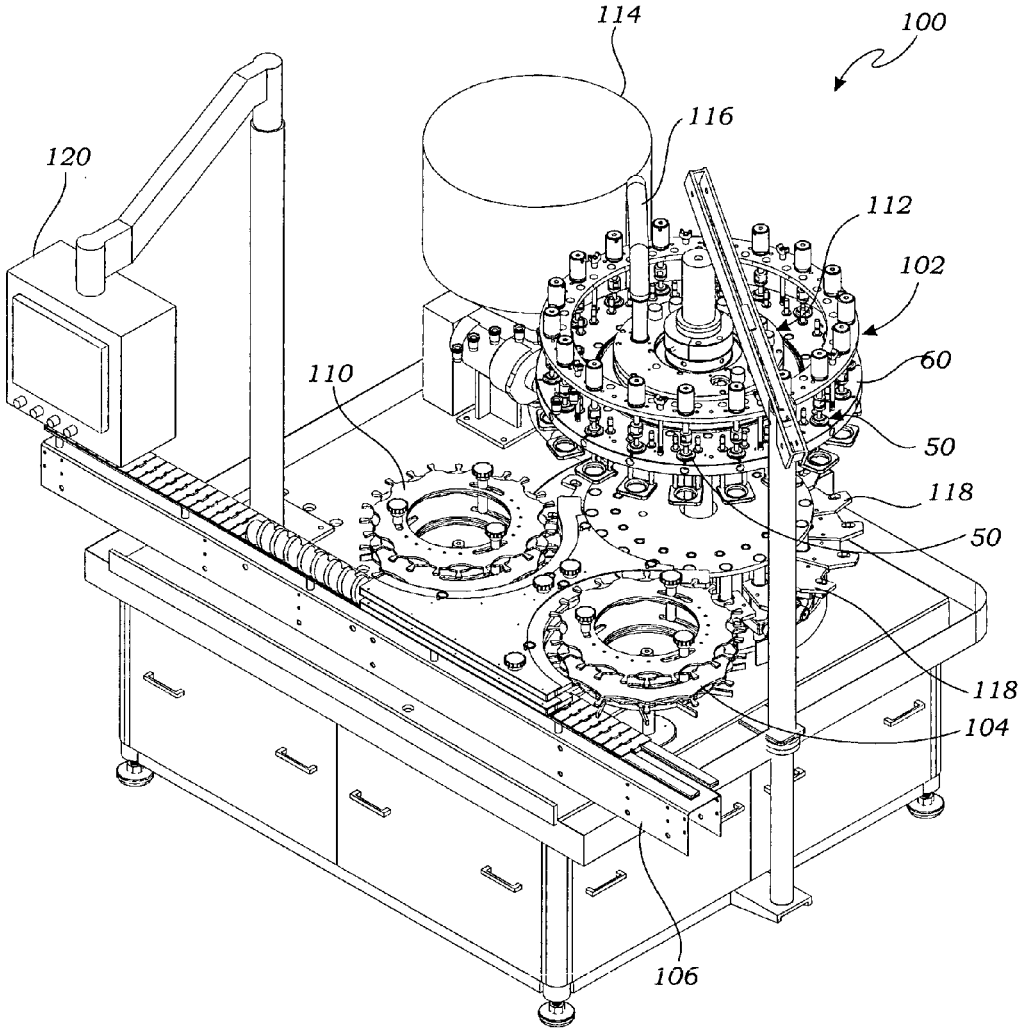
FIG. 7 is a perspective view of a rotary liquid filling machine according to the present invention.

The filling valve 52 comprises a housing 70 having a base 72, a cap 74 and a sidewall 76 extending between the base 72 and the cap 74. A cross-sectional view of just the housing 70 of the valve 52 is shown in FIG. 6 and a perspective view of the housing 70 is shown in FIG. 7. The housing 70 is preferably generally cylindrical in shape (having a circular cross-section) but it is understood that the housing 70 may alternatively have a square, rectangular or other suitable cross-section depending on the particular application of the valve 52. The base 72 of the housing 70 has a ramp 78 which slopes from a bottom surface 80 of the base 72 toward the cap 74. The base 72, cap 74 and sidewall 76 form a partially enclosed chamber 81. The ramp 78 provides several benefits. For one, the ramp 78 forms a "trap" effect to control loss of fluid that tends to occur during the cycle of stopping and starting an automated filling machine using the valve 52. Moreover, the ramp 78 prevents clogging and product entrapment in the area within the chamber 81 which is normally prone to clogging and product entrapment, namely the area of the chamber on the opposite side of the inlet port. 88.

An outlet tube 82 extends from the exterior of the housing 70 through the base 72 and into the chamber 81. The outlet tube 82 preferably extends into the chamber 81 to a point at or just below the top of the ramp 78. Alternatively, the outlet tube may extend into the chamber 81 to a point slightly above the ramp. The outlet tube 82 is preferably formed integrally with the housing 70 but it may be also be formed separately and then welded or otherwise suitably attached to the housing 70. The outlet tube 82 has an inlet opening 84 which opens into the chamber 81 to allow product to flow from the chamber 81 into the outlet tube 82 when the valve 52 is in the open position (see FIG. 4). The outlet tube 82 also has an outlet opening 86 which allows product to flow out of the valve 52 and into a container (not shown) being filled. A nozzle (not shown) may also be attached to the end of the outlet tube 82 as an extension of the outlet tube 82. The nozzle may be any desired length and may also neck down to a diameter smaller than the diameter of the outlet tube 82. The nozzle may be beneficial for filling containers which are shorter or which have smaller openings.

A plunger 90 is slidably received in the outlet tube 82. The plunger 90 is preferably a cylindrical rod made of a durable polymer, such as Teflon™, which can form a fluid tight seal with the outlet tube and slide in and out of the outlet tube 82 without excessive friction. The plunger 90 has a tight tolerance fit within the outlet tube 82 such that the plunger 90 effectively seals the outlet tube 82 when the plunger is inserted into the outlet tube 82. When the valve 52 is in the closed position (see FIG. 3), a distal end 96 of the plunger 90 extends at least substantially all the way to the end of the outlet tube (i.e. to the outlet opening 86) such that there is complete product displacement when the valve 52 is closed. In this way, the plunger 90 clears/displaces the product in the valve 52 at the end of a fill cycle and also provides a positive seal at the point of discharge, thereby eliminating product drip. A sanitary plunger seal 98 may be provided at or near the distal end 96 to further ensure a fluid tight seal between the plunger 90 and the outlet tube 82.

A product inlet port 88 extends from the exterior of the housing 70 and through the sidewall 76 such that the inlet port 88 is in fluid communication with the chamber 81. The product inlet port 88 has a flange 92 so that it may be clamped to a mating flange of the product supply pipe 58. Again, the inlet port 88 may be formed integrally with the housing 70 or it may be formed separately and then welded or otherwise suitably attached to the housing 70.

A plunger guide 94 is provided in the cap 74 and has an opening extending through the cap 74. The plunger guide 94 has two main functions. First, similar to the outlet tube 82, the plunger guide 94 slidably receives the plunger 90 and has a tight tolerance fit with the plunger 90 such that the plunger 90 seals the opening extending through the cap 74. Second, the plunger guide 94 helps support the plunger 92 as it moves up and down to open and close the valve 52. The plunger guide 74 may be an integral part of the cap 74 or it may be a separate part welded or otherwise connected to the cap 74. The plunger guide 94 or cap 74 has a flange 99 for clamping to the cap retainer 64.

In operation of the filling station 50, pressurized liquid product is directed into the product supply pipe 58. The valve 52 begins in the closed position (see FIG. 3) with the plunger 90 fully extended into the outlet tube 82 such that the outlet tube 82 is sealed. The inlet port 88 and chamber 81 will fill with product. To open the valve 52, a valve (not shown) is opened to allow compressed air to actuate the air cylinder actuator 54. The air cylinder actuator 54 pulls the plunger 90 upward thereby withdrawing the plunger 90 out of the outlet tube 82. The valve 52 does not open until the distal end 96 of the plunger 90 is completely withdrawn from the outlet tube 82. Once this occurs, product flows from the chamber 81 into the inlet opening 84 in the outlet tube 82, through the outlet tube 82, out of the outlet opening 86 and into a container (not shown) to be filled. The withdrawal of the plunger 90 is stopped before the distal end 96 of the plunger 90 is removed from the plunger guide 94 such that the seal between the plunger 90 and the plunger guide 94 is always maintained.

Once the desired amount of product has been dispensed into the container, the valve 52 is closed by actuating the air cylinder actuator 54 in the opposite direction thereby pushing the plunger 90 back into the outlet tube 82 thereby sealing the outlet tube 82.

Turning to FIG. 7, a rotary liquid filling machine 100 according to the present invention is shown. The filling machine 100 utilizes a plurality of liquid filling stations 50 as described above and like reference numerals used in FIG. 8 refer to like elements described above. The filling machine 100 further comprises a rotor 102, a conveyor 106, an inlet spindle 108, and an outlet spindle 110.

In addition to the plurality of filling stations 50, the rotor 102 comprises a product distribution turret 112 which distributes the liquid product being pumped into the turret 112 to a product supply pipe 58 of each of the filling stations 50. The liquid product is supplied to the turret 112 through a product supply line 116 connected to a product reservoir 114. A container holding device 118 is provided for each filling station 50. The container holding device 118 is configured to support the containers being filled and is capable of synchronously raising and lowering the containers under the outlet tube 82 to properly position the containers relative to the outlet tube 82 during the loading, filling, and unloading of the containers on the liquid filling machine 100. A controller 120 is in operable communication with the necessary components of the liquid filling machine 100 to control and coordinate the operation of the liquid filling machine 100.

The liquid filling machine 100 can fill containers at a very high speed. Moreover, the filling machine can be used to fill containers with a wide variety of liquid products including low viscosity liquids, semi-viscous liquids, and/or liquids having mixed-in solid particles or particulate without clogging in the valves 52. In addition, the entire system allows for clean-in-place (CIP) cleaning to a sanitary level. While a rotary liquid filling machine 100 has been described herein, it is contemplated within the present invention that the filling station 50 and/or valve 52 may be used on any type of liquid filling machine, including in-line filling machines.

While the present invention has been fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

The invention claimed is:

1. A valve having an open position and a closed position, comprising:

a housing having a base, a cap opposing said base and a sidewall extending between said base and said cap, said base having a ramp which slopes from a bottom surface of said base toward said cap, said base, said cap and said sidewall forming a chamber;

an outlet tube extending from the exterior of said housing through said base and into said chamber, said outlet tube having an inlet opening in fluid communication with said chamber when said valve is in the open position, and said outlet tube having an outlet opening;

an inlet port extending from the exterior of said housing through said sidewall;

a plunger guide having an opening extending through said cap;

a plunger slidably received in said plunger guide and said outlet tube, said plunger movable between the closed position in which said plunger is in an extended position such that said plunger is positioned in said outlet tube thereby sealing said opening in said outlet tube from said chamber and the open position in which said plunger is in a withdrawn position such that said plunger is withdrawn from said outlet tube thereby unsealing said inlet opening in said outlet tube.

2. The valve of claim 1 wherein said plunger comprises a cylindrical, elongate rod and said plunger guide and outlet tube comprise cylindrical surfaces for receiving said plunger.

3. The valve of claim 1 wherein said housing is substantially cylindrical.

4. The valve of claim 1 wherein said ramp extends toward said cap to a point at or below the opening in said outlet tube.

5. The valve of claim 1 wherein said ramp extends toward said cap to a point above said opening in said outlet tube.

6. The valve of claim 1 further comprising a nozzle in fluid communication with said outlet tube, said nozzle having a nozzle inlet and a nozzle outlet.

7. The valve of claim 1 wherein, in the closed position of said valve, said plunger extends to said outlet opening of said outlet tube.

8. The valve of claim 6 wherein, in the closed position of said valve, said plunger extends to said nozzle outlet.

9. The valve of claim 1 wherein at least said base, said outlet tube and said sidewall comprise a first integral part.

10. The valve of claim 1 wherein at least said cap and said plunger guide comprise an integral part.

11. The valve of claim 9 wherein said cap and said plunger guide comprise a second integral part which is attached to said first integral part.

12. The valve of claim 1 wherein said valve is for use in an automated liquid filling system and said valve is configured to allow for sanitary clean-in-place cleaning of the valve.

13. A liquid filling system for the automated filling of containers with liquid product and liquid product with particulates, comprising:

a container handling subsystem for transporting containers to and from a liquid filling machine;

a liquid filling machine comprising a plurality of filling stations, each filling station comprising the valve of claim 1 and an actuation device for opening and closing said valve;

a controller in communication with said container handling subsystem and said liquid filling machine for controlling and coordinating the operation of the container handling subsystem and the liquid filling machine.

14. The liquid filling system of claim 13 wherein said actuation device is one of a cam operated actuator or an air cylinder.

15. The liquid filling system of claim 13 further comprising a product reservoir, a product pump and a product distribution turret for pumping and distributing the product from the product reservoir to each of the filling stations.

16. A valve having an open position and a closed position, comprising:

a substantially cylindrical housing having a base, a cap opposing said base and a cylindrical sidewall extending between said base and said cap, said base having a ramp which slopes from a bottom surface of said base toward said cap, said base, said cap and said sidewall forming a chamber;

an outlet tube extending from the exterior of said housing through said base and into said chamber, said outlet tube having an inlet opening in fluid communication with said chamber when said valve is in the open position, and said outlet tube having an outlet opening;

an inlet port extending from the exterior of said housing through said sidewall;

a plunger guide comprising a cylindrical tube extending through said cap;

a plunger comprising a cylindrical rod, said plunger slidably received in said plunger guide and said outlet tube, said plunger movable between the closed position in which said plunger is in an extended position such that said plunger is positioned in said outlet tube thereby sealing said opening in said outlet tube from said chamber and the open position in which said plunger is in a withdrawn position such that said plunger is withdrawn from said outlet tube thereby unsealing said inlet opening in said outlet tube.

17. The valve of claim 16 wherein said ramp extends toward said cap to a point at or below the opening in said outlet tube.

18. The valve of claim 16 wherein said ramp extends toward said cap to a point above said opening in said outlet tube.

19. The valve of claim 16 further comprising a nozzle in fluid communication with said outlet tube, said nozzle having a nozzle inlet and a nozzle outlet.

20. The valve of claim 16 wherein, in the closed position of said valve, said plunger extends to said outlet opening of said outlet tube.

21. The valve of claim 19 wherein, in the closed position of said valve, said plunger extends to said nozzle outlet.

22. The valve of claim 16 wherein at least said base, said outlet tube and said sidewall comprise a first integral part.

23. The valve of claim 16 wherein at least said cap and said plunger guide comprise an integral part.

24. The valve of claim 22 wherein said cap and said plunger guide comprise a second integral part which is attached to said first integral part.

25. The valve of claim 16 wherein said valve is for use in an automated liquid filling system and said valve is configured to allow for sanitary clean-in-place cleaning of the valve.

* * * * *